US005080720A

United States Patent [19]

Titmas

[11] Patent Number: 5,080,720

[45] Date of Patent: Jan. 14, 1992

[54] METHOD AND APPARATUS FOR CLEANING THE ANNULUS FORMED BY CONCENTRIC PIPES

[75] Inventor: James A. Titmas, 347 Crain Ave., Kent, Ohio 44240

[73] Assignee: Titmas and Associates Incorporated, Hudson, Ohio

[21] Appl. No.: 535,559

[22] Filed: Jun. 11, 1990

[51] Int. Cl.[5] ..... B08B 3/02

[52] U.S. Cl. ..... 134/22.11; 134/167 C; 134/180; 134/179

[58] Field of Search ..... 134/166 C, 167 C, 168 C, 134/169 C, 172, 176, 179, 180, 198, 107 R, 22.11; 239/127.1, 265.25, 265.19, 265.27

[56] References Cited

U.S. PATENT DOCUMENTS

| | | | |
|---|---|---|---|
| 2,807,272 | 9/1957 | McCray | 134/167 C |
| 3,236,249 | 2/1966 | Everroad | 134/167 R |
| 4,224,108 | 9/1980 | Takahashi et al. | 134/167 R X |
| 4,349,073 | 9/1982 | Zublin | 134/167 C X |
| 4,594,164 | 6/1986 | Titmas | 210/741 |
| 4,699,163 | 10/1987 | Baziuk | 134/167 C |
| 4,763,728 | 8/1988 | Lacey | 166/191 |
| 4,764,180 | 8/1988 | Shaddock | 134/167 C X |
| 4,781,250 | 11/1988 | McCormick et al. | 166/240 |
| 4,799,554 | 1/1989 | Clapp et al. | 166/312 |
| 4,805,650 | 2/1989 | Yasui et al. | 134/167 R X |
| 4,884,585 | 12/1989 | Oh | 134/176 |

FOREIGN PATENT DOCUMENTS

| | | | |
|---|---|---|---|
| 133333 | 7/1949 | Australia | 134/179 |

*Primary Examiner*—Frankie L. Stinson

*Attorney, Agent, or Firm*—Renner, Kenner, Greive, Bobak, Taylor & Weber

[57] ABSTRACT

An apparatus for cleaning an annulus (13) formed between two generally concentric pipes (11, 12) includes a cleaning head (14) carried by feed tubes (15, 16) which position the head (14) at selected vertical positions within the annulus (13). The feed tubes (15, 16) carry fluid under pressure to the head (14). A valve (40) controls which of the feed tubes (15, 16) is receiving fluid under pressure. When valve (40) provides fluid through the tube (16), fluid is emitted through nozzles (18, 22, 25) in the head (14) to move the head (14) in one direction around the annulus (13) and clean the annulus (13). When valve (40) alternatingly provides fluid through the tube (15), fluid is emitted through nozzles (31, 32, 33) in the head (14) to move the head (14) in an opposite direction around the annulus (13). The head (14) may be simultaneously moved vertically within the annulus (13).

16 Claims, 4 Drawing Sheets

METHOD AND APPARATUS FOR CLEANING THE ANNULUS FORMED BY CONCENTRIC PIPES

TECHNICAL FIELD

This invention relates to a method and apparatus for cleaning deposits from the opposed surfaces of an outer casing and inner liner which form the working annulus of a gravity pressure vessel. The cleaning is accomplished without taking the gravity pressure vessel out of service.

BACKGROUND ART

It has long been known that the inside surfaces of a vertical tube or pipe can be cleaned using a high pressure water spray. This is done on a routine basis, for example, in the oil well industry. In general, these methods involve lowering a spray head on the end of a small diameter metal tube. The spray is directed radially in all directions and the velocity of the fluid stream against the wall loosens the materials adhered to the wall.

To enhance the action of the spray, devices were developed wherein the spray head is caused to rotate as shown in U.S. Pat. No. 4,799,554 and U.S. Pat. No. 4,781,250. In these devices, cams and lugs interact to cause the spray head to shift its position vertically and radially. In another patent, U.S. Pat. No. 4,763,728, the spray is also directed radially and a sump is provided to pick up the debris and convey it away. However, none of these existing patents are effective in cleaning both sides of an annulus formed when pipes are concentrically nested and the passage to be cleaned is the inner surface of an outer pipe and the outer surface of an inner pipe as is found in a conventional gravity pressure vessel.

One method of cleaning the annuli in a gravity pressure vessel is described in U.S. Pat. No. 4,594,164. There it is suggested that nitric acid can be introduced, after a conditioning or cooling step, to dissolve away mineral deposits such as calcium sulfate. This results in the need to interrupt production, cool the apparatus, clean the apparatus, and then re-heat the system before going back into production. For a mineral content typical of most waste streams being treated by the gravity pressure vessel, this process may have to be repeated every ten days. As this procedure requires at least a day to complete, it results in a potential loss of ten percent of the operational payback from system operation. Further, not only are such acid washes potentially dangerous to the user, but also they are not completely effective against silicates which have a tendency to gradually accumulate over the life of the gravity pressure vessel. Thus, the unique needs of cleaning the passages in a gravity pressure vessel go unresolved.

DISCLOSURE OF THE INVENTION

It is thus a primary object of the present invention to provide a method and apparatus for the cleaning of the surfaces of an annulus formed between concentrically nested vertical pipes.

It is a further object of the present invention to provide a method and apparatus, as above, which can clean the passages in a gravity pressure vessel without taking the gravity pressure vessel out of production.

It is another object of the present invention to provide a method and apparatus, as above, which will permit frequent and essentially continuous cleaning of a gravity pressure vessel to maintain uniform and consistent heat transfer rates and stable operation.

It is an additional object of the present invention to provide a method and apparatus, as above, which can clean the passages of a gravity pressure vessel without having to cool the same.

These and other objects of the present invention, as well as the advantages thereof over existing prior art forms, which will become apparent from the description to follow, are accomplished by the improvements hereinafter described and claimed.

In general, the method and apparatus for cleaning a gravity pressure vessel while still in service includes a cleaning head vertically positionable in the annulus formed between two generally concentric generally vertical pipes of the gravity pressure vessel. Fluid under pressure is provided to the cleaning head and alternatingly such fluid under pressure is provided to selected nozzles in the cleaning head to cause the cleaning head to sweep from side to side in the annulus while simultaneously moving vertically through said annulus, covering all the wall surfaces with an intense cleaning spray.

A preferred exemplary method and apparatus for cleaning an annulus formed by concentric pipes incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
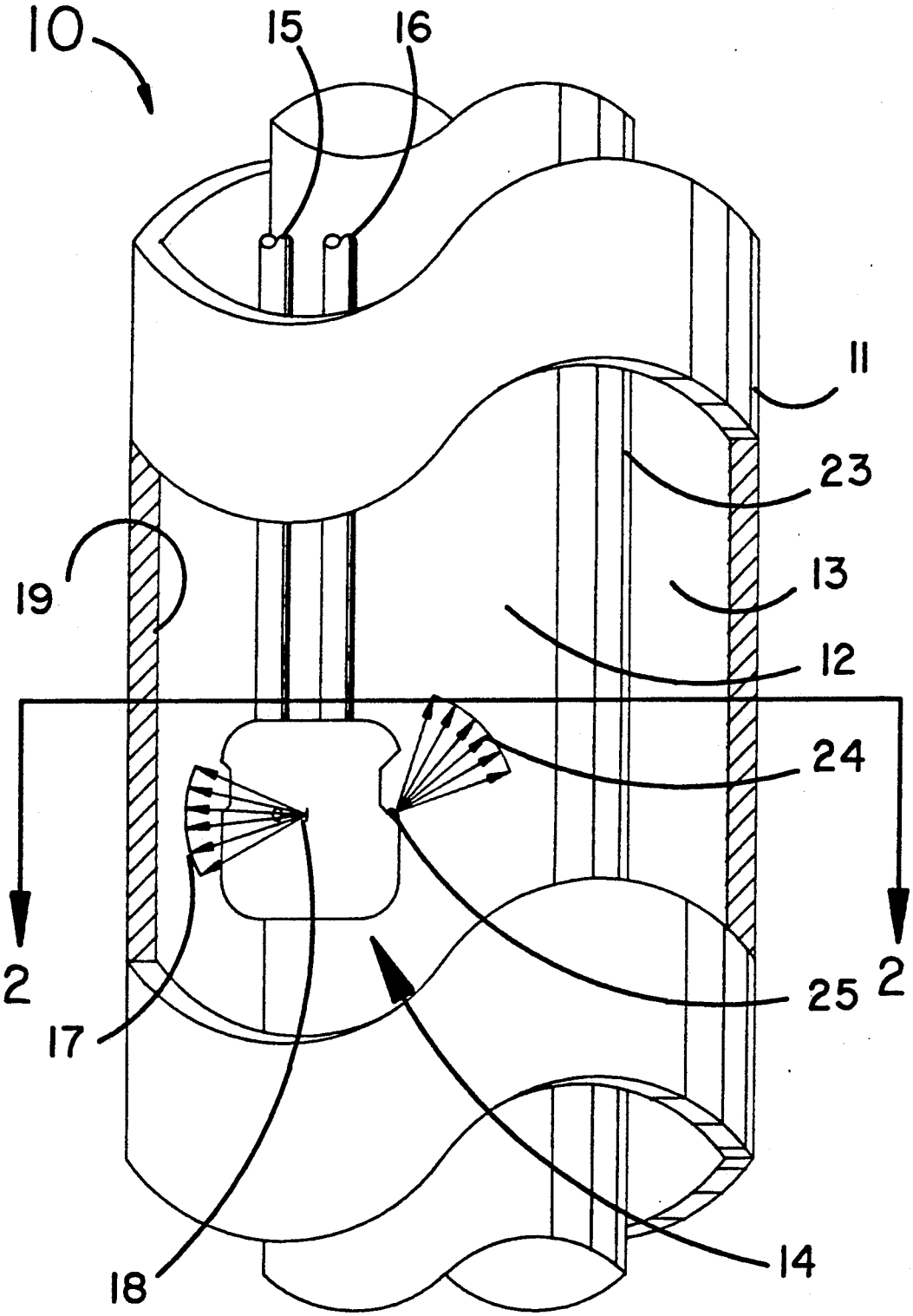
FIG. 1 is a partial broken away view of an annulus passage formed by two concentrically nested pipes with the cleaning head fan jets of the present invention somewhat schematically shown in working position.

The concentrically nested vertical pipes such as are found in the environment of a gravity pressure vessel, as shown in U.S. Pat. No. 4,594,164, to which reference is made for whatever details may be necessary to understand the environment of the subject invention, are generally indicated by the numeral 10 in FIG. 1. Nested vertical pipes 10 include an outer pipe 11 and an inner pipe 12 with an annulus 13 formed therebetween. A cleaning head generally indicated by the numeral 14, is supported in annulus 13 by a pair of feed tubes 15 and 16 that supply alternating fluid streams to cleaning head 14. Tubes 15 and 16 can be carried on a reel (not shown) positioned above the gravity pressure vessel so that they may be raised and lowered, as desired. Moreover, tubes 15 and 16 are flexible in nature so that, as will hereinafter be described, they may freely swing within annulus 13.

Figure 2:
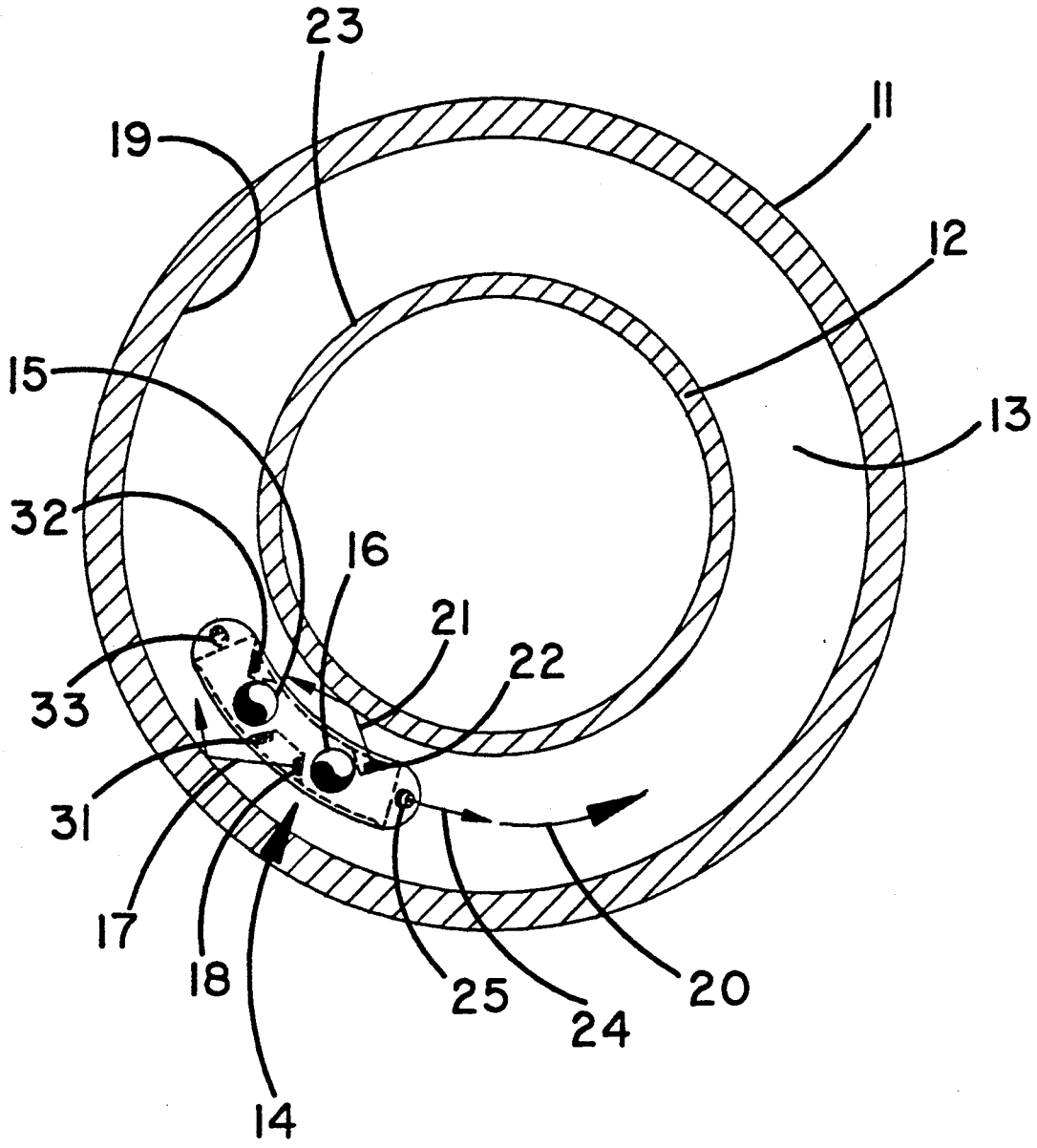
FIG. 2 is a sectional view taken substantially along line 2—2 of FIG. 1 and showing the action of the fan jet sprays working against the pipe surfaces.
Figure 3:
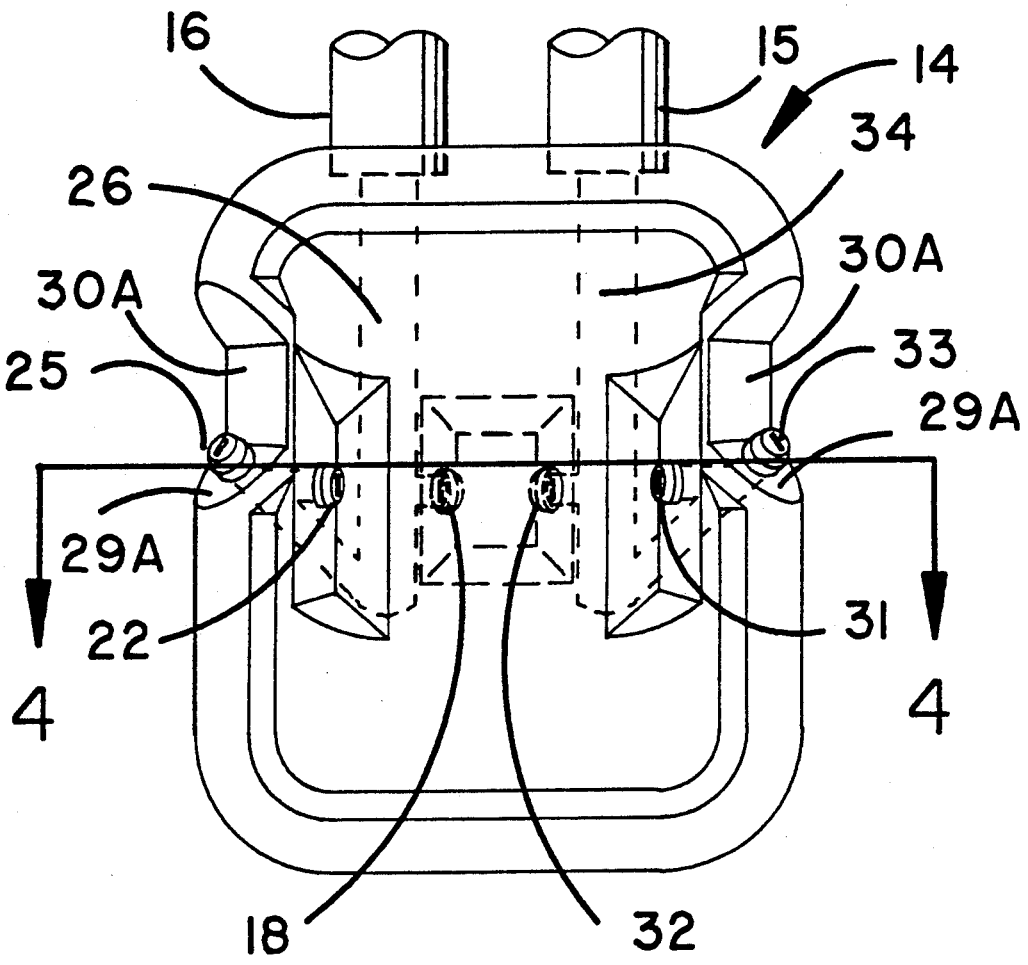
FIG. 3 is a somewhat schematic view of the cleaning head according to the concepts of the present invention, the side thereof being shown being the side opposite to that which is shown in FIG. 1.

Feed tube 16 supplies fluid to create a fluid spray fan jet 17 through a replaceable nozzle 18 which both cleans the inner surface 19 of pipe 11 and at the same time imparts a jet like or thrust force causing cleaning head 14 to move to the right as seen in FIG. 1 or arcuately counterclockwise within annulus 13 as indicated by arrow 20 (FIG. 2). As also shown in FIG. 2, feed tube 16 supplies fluid to create a second cleaning and thrusting fluid spray fan jet, schematically indicated as at 21, through a replaceable nozzle 22. Spray jet 21 is equal in force and direction with spray jet 17 and cleans the outside wall 23 of pipe 12. Of course, spray jet 21 also assists in moving cleaning head 14 in the direction of arrow 20.

In counterforce to the thrusting action of spray jet 17 and its companion, spray jet 21, is a spray fan jet 24 which is created from fluid transmitted through a replaceable nozzle 25 from feed tube 16. The direction of fan jet 24 is partially upward to impart a downward force which together with the weight of cleaning head 14 assists in assuring the downward movement of head 14. Despite the jet action of fan 24, the head 14 moves to the right due to the double action of the fan jet 17 and fan jet 21. While fan jets 17 and 21 are thus directly impinging on walls 19 and 23, respectively, fan jet 24 is cleaning both walls 19 and 23 ahead of it. In fact, jet 24 will provide cleaning action almost entirely around annulus 13. Similarly, jets 17 and 21 clean walls 19 and 23 a substantial distance rearwardly of head 14.

Figure 4:
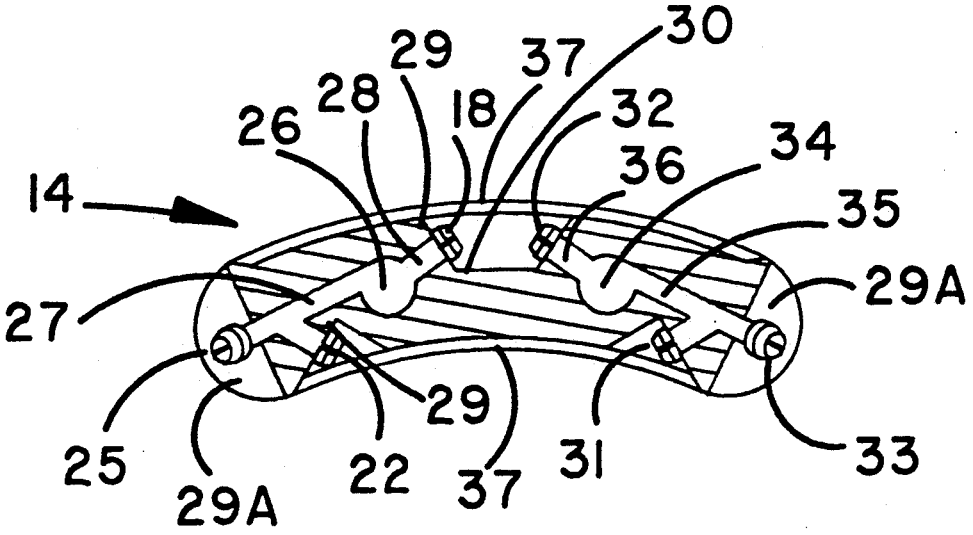
FIG. 4 is a sectional view taken substantially along line 4—4 of FIG. 3.

As best shown in FIG. 4, fluid from feed tube 16 passes through a drilled vertical passage 26 in head 14 and then is provided, via drilled passage 27, to nozzles 22 and 25. Similarly, passage 26 communicates with nozzle 18 via drilled passage 28. In this manner the three nozzles 18, 22 and 25 receive equal flow, and thus create the force imbalance that moves head 14. The spray jet fans 17 and 21 delivered from nozzles 18 and 22, respectively, are deliberately shaped to impact surfaces 19 and 23 on an angle to enhance cleaning and the lifting away of the deposit while simultaneously providing the motive force to move head 14 in the desired direction. This angle, preferably in the range of thirty to fifty degrees, is created by mounting nozzles 18 and 22 on angled surfaces 29 formed within recesses 30 in the outer walls of head 14. Recesses 30 also protect the nozzles from any damage.

Forward spray jet fan 24 emitted from nozzle 25 is also mounted on an angled surface 29A within a recess 30A. This angled surface directs spray jet fan 24 generally upwardly at an angle in the range of thirty to fifty degrees so that it will be above spray jet fans 17 and 21 and thereby not cancel out the scrubbing action of spray jet fans 17 and 21. Moreover, as previously described, the upward spray emission from nozzle 25 assists in moving head 14 downwardly in annulus 13.

When head 14 moves to the right as shown in FIG. 1 or counterclockwise a sufficient distance for spray fan 24 to have cleaned forward areas of annulus 13 not traversed by head 14, and for spray fans 17 and 21 to have cleaned rearward areas of annulus 13 not traversed by head 14, the delivery of fluid from tube 16 to create jet fans 17, 21 and 24 is decreased and stopped. Normally it is only necessary for head 14 to have transcribed an arc of no more than 180° for the jet fans 17, 21, and 24 to have provided sufficient cleaning force around the entire annulus. Then, at that point in time, the system is reversed. Fluid pressure is provided to tube 15 which activates opposite spray fan jets (not shown) through nozzles 31, 32 and 33, respectively. These spray fan jets operate just like spray fan jets 17, 21 and 24, respectively, to move head 14 back to the left, or clockwise around annulus 13. Fluid from feed tube 15 passes through a drilled vertical passage 34 in head 14 and then is provided, via drilled passage 35 to nozzles 31 and 33. Similarly, passage 34 communicates with nozzle 32 via drilled passage 36. In this manner, like nozzles 18, 22 and 25, nozzles 31, 32 and 33 receive equal flow and thus create the force to move head 14 to the left or clockwise through annulus 13. Nozzles 31 and 32 are also mounted on angled surfaces 29 within recesses 30 and nozzle 33 is mounted on angled surface 29A within recess 30A for protection and to create the same (but reversed) angled spray as was discussed with respect to nozzles 18, 22 and 25.

As head 14 is moved arcuately to the right and to the left, tubes 15 and 16 are slowly lowered from their mounting reels (not shown) at the top of the gravity pressure vessel. Potential trapping of head 14 in annulus 13 between walls 19 and 23 is prevented by a recessed contour 37 (FIG. 4) which extends all the way around head 14 and which permits the formation of a fluid cushion to allow head 14 to glide through annulus 13. After head 14 has been lowered the entire height of the gravity pressure vessel, while simultaneously sweeping from side to side, the process is reversed and head 14 is raised with the same continuously sweeping side to side cleaning motion as used while it was being lowered. When head 14 has returned to the top of the vessel, the apparatus is ready for its next cycle. A conventional access opening (not shown) at the top of outer pipe 11 allows one to service head 14 and replace any of the nozzles as may be necessary or desired.

Figure 5:
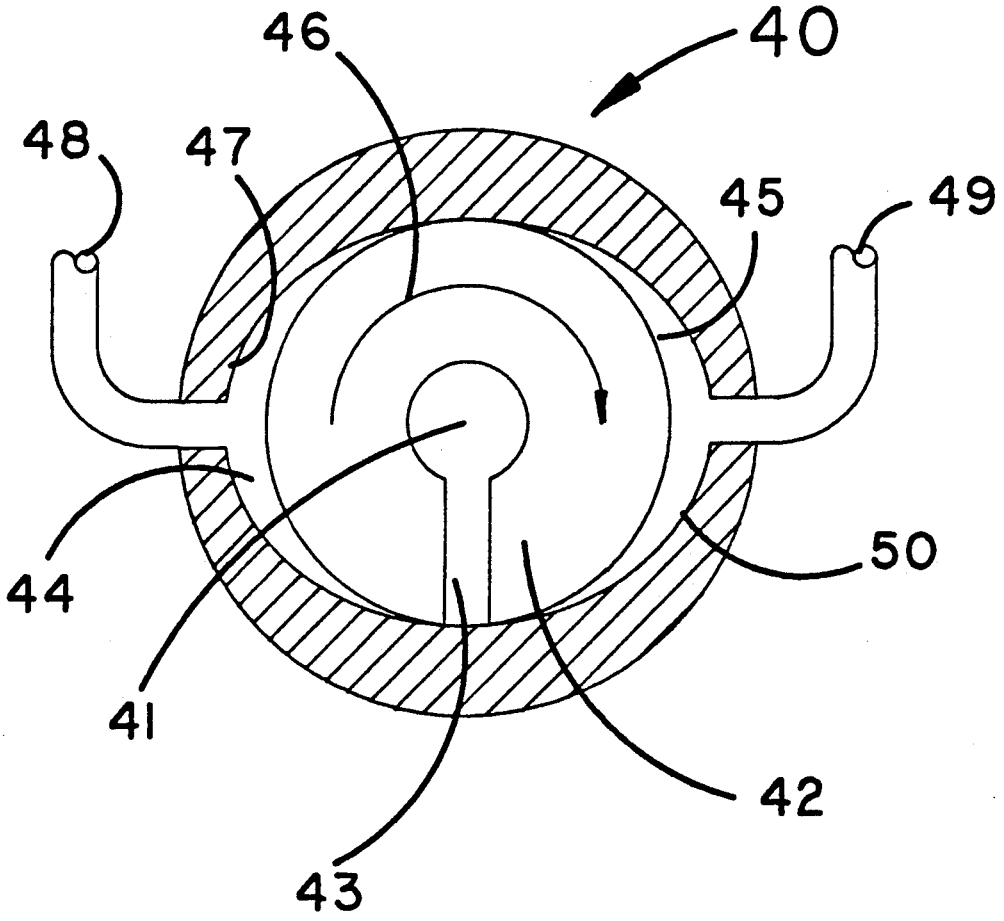
FIG. 5 is a sectional view of the rotating valve device used to alternately charge the fluid fan jets.

A valve, indicated generally by the numeral 40 and shown in FIG. 5, is positioned outside of the gravity pressure vessel and controls the flow to tubes 15 and 16. A high pressure cleaning fluid is admitted to the center of the valve, as at 41, into core 42 which is equipped with a keyway 43 which communicates fluid pressure to chambers 44 and 45. Core 42 is rotated as indicated by arrow 46. As keyway 43 approaches chamber 44, the surface 47 of which is shaped to prevent a sudden inrush of fluid which could cause water hammer, the fluid pressure at the center 41 of valve 40 is passed on to tube 48 which in turn communicates with tube 15. As core 42 continues to turn, the flow to chamber 44 is cut off and the flow from center 41 of valve 40 passes to chamber 45 and thence to tube 49 which communicates with tube 16. Chamber 45 likewise has a surface 50 contoured to prevent a sudden inrush of fluid which could cause water hammer. It should thus be evident that by regulating the speed at which core 42 turns, the oscillating motion of cleaning head 14 is controlled.

Thus the cleaning of a gravity pressure vessel by the method described herein can be practiced without taking said vessel out of service. The selection of the cleaning fluid is not restricted and may be an acid solution, water, caustic solution, a gas, or a process reactant as required for the process needs.

It should thus be evident that the device described herein accomplishes the objects of the present invention and otherwise substantially improves the art of cleaning the annuli of a gravity pressure vessel.

I claim:

1. Apparatus for cleaning an annulus formed between two generally concentric generally vertical pipes comprising a cleaning head positionable vertically in the annulus, means to provide fluid under pressure to said cleaning head, and nozzle means in said cleaning head to emit fluid to clean the annulus and at the same time to move said cleaning head around the annulus, said nozzle means including a plurality of thrust nozzles emitting jets of fluid in one direction against the walls of the vertical pipes to clean the vertical pipes and to move said cleaning head in the other direction, and a forward nozzle emitting a jet of fluid in said other direction to clean the vertical pipes.

2. Apparatus according to claim 1 wherein said cleaning head includes passageways communicating with said means to provide fluid under pressure, with said thrust nozzles, and with said forward nozzle such that all of said nozzles receive an equal fluid flow.

3. Apparatus according to claim 1 wherein said cleaning head is provided with angled surfaces, all of said nozzles being positioned on said angled surfaces.

4. Apparatus according to claim 3 wherein said cleaning head is provided with recesses, said recesses including said angled surfaces so that all of said nozzles are recessed within the outer periphery of said cleaning head.

5. Apparatus according to claim 1 wherein said cleaning head is provided with means on its outer periphery to prevent said cleaning head from lodging within the annulus.

6. Apparatus for cleaning an annulus formed between two generally concentric generally vertical pipes comprising a cleaning head positionable vertically in the annulus, means to provide fluid under pressure to said cleaning head, and nozzle means in said cleaning head to emit fluid to clean the annulus and at the same time to move said cleaning head around the annulus, said nozzle means including first thrust nozzle means to emit fluid in a first direction to move said cleaning head in a second direction arcuately opposite to said first direction, second thrust nozzle mean to emit fluid in said second direction to move said cleaning head in said first direction, first forward nozzle mean to emit fluid in said second direction when said first thrust nozzle means is emitting fluid in said first direction, and second forward nozzle mean to emit fluid in said first direction when said second thrust nozzle means is emitting fluid in said second direction.

7. Apparatus according to claim 6 wherein said mean to provide fluid under pressure includes a first feed tube providing fluid under pressure to said first thrust nozzle means and said first forward nozzle means, and a second feed tube providing fluid under pressure to said second thrust nozzle means and said second forward nozzle means.

8. Apparatus according to claim 7 wherein said first and second feed tubes control the vertical position of said cleaning head in the annulus.

9. Apparatus according to claim 7 further comprising valve means to provide fluid under pressure alternatingly to said first tube and said second tube.

10. Apparatus according to claim 9 wherein said valve means includes a rotatable core, the speed of the rotation of said core controlling the speed at which fluid under pressure is provided alternatingly to said first tube and said second tube.

11. Apparatus according to claim 10, wherein the fluid under pressure is provided to said core, said valve means further including keyway passageway means in said core, said keyway passageway alternatingly providing fluid under pressure to said first tube and said second tube as said core rotates.

12. Apparatus according to claim 10, said valve means further including means to prevent water hammer as the fluid under pressure is alternatingly provided to said first tube and said second tube.

13. A method of cleaning an annulus formed between two generally concentric generally vertical pipes comprising the steps of positioning a cleaning head having a plurality of fluid emitting nozzles within the annulus, providing fluid under pressure to the cleaning head, permitting fluid to be emitted through a selected plurality of nozzles in one direction thereby moving the cleaning head in the other direction around the annulus, permitting fluid to be emitted through other of the nozzles thereby moving the cleaning head in said one direction around the annulus, and permitting fluid to be emitted from a nozzle in said other direction.

14. A method according to claim 13 further comprising the step of moving the cleaning head vertically in the annulus while permitting fluid to be emitted through said selected plurality of the nozzles and said other of the nozzles.

15. A method according to claim 13 wherein the step of permitting fluid to be emitted through other of the nozzles includes the step of permitting fluid to be emitted from a plurality of nozzles in said other direction and permitting fluid to be emitted from a nozzle in said one direction.

16. A method according to claim 15 wherein the steps of permitting fluid to be emitted through selected of the nozzles and permitting fluid to be emitted through other of the nozzles are alternated.

* * * * *